United States Patent [19]

Thorneburg

[11] 4,257,522

[45] Mar. 24, 1981

[54] HOSIERY DISPLAY HANGER PACKAGE

[76] Inventor: James L. Thorneburg, P.O. Box 5440, Statesville, N.C. 28677

[21] Appl. No.: 67,346

[22] Filed: Aug. 17, 1979

[51] Int. Cl.[3] ..... B65D 85/18; B65D 75/00

[52] U.S. Cl. ..... 206/299; 206/806

[58] Field of Search ..... 206/278, 288, 292, 297, 206/299, 806; 229/40

[56] References Cited

U.S. PATENT DOCUMENTS

| | | | |
|---|---|---|---|
| 1,651,172 | 11/1927 | Youngblood | 206/278 |
| 3,487,915 | 1/1970 | Scott | 229/40 |
| 4,014,436 | 3/1977 | Tunis | 206/299 |

*Primary Examiner*—William T. Dixson, Jr.
*Attorney, Agent, or Firm*—Bell, Seltzer, Park & Gibson

[57] ABSTRACT

The package displays hosiery articles, such as pairs of socks, on the horizontal pins of a merchandizing display rack so that they are visible for inspection by prospective buyers. The package includes a hanger support panel (10, 11) and an integral hosiery support band formed of a rear panel (13), a front panel (14), and a pair of side panels (15, 20). The medial portion of a pair of flattened socks is resiliently engaged and supported by the support band with portions of the socks being visible above and below the support band.

7 Claims, 7 Drawing Figures

HOSIERY DISPLAY HANGER PACKAGE

FIELD OF THE INVENTION

This invention relates generally to a hosiery display hanger package formed of paperboard or the like and more particularly to such a package which is adapted to support a pair of hosiery articles, such as socks, for display on a pin-type merchandising rack.

BACKGROUND OF THE INVENTION

It is well known to provide various types of packages from stiff material such as paperboard, plastic and the like, to display various types of clothing, hardware and other goods on pin-type merchandizing racks. Hosiery articles, such as socks, have also been displayed in packages which hang on pin-type merchandizing racks. For example, U.S. Pat. No. 4,132,309 discloses a sock package formed from a single piece paperboard blank with the inside of the blank being provided with a pressure sensitive adhesive coating. The blank is folded so that a portion of the package surrounds the socks with the pressure sensitive adhesive in physical contact with the socks to adhesively support the socks in the package. The package of this patent does not permit the easy removal and replacement of the socks supported thereby because the pressure sensitive adhesive is in direct contact with the socks.

SUMMARY OF THE INVENTION

The hosiery display hanger package of the present invention includes an integral support band which encircles the medial portion of a pair of flattened socks and resiliently maintains the socks in the package with the upper and lower end portions of the socks being visible above and below the support band for inspection by prospective buyers. The present package provides adequate space for advertising and information to identify the type hosiery articles contained therein, and is provided in various sizes to support various types and sizes of hosiery articles therein.

The present hosiery display hanger package is formed from a single piece paperboard blank which is scored for folding so that the entire outer surface of the display package is formed by one side of the single piece blank, thereby making it possible to use a type paperboard which has a more expensive calendered finish on only one side, the side to be used as the outer surface of the display package. Also, suitable advertising and product identification information can be printed on all outwardly facing surfaces of the display package by printing on only one side of the blank. The assembled display package may be easily folded flat to conserve space in the shipment of large numbers of the display packages.

The present hosiery display hanger package is formed from a substantially L-shaped paperboard blank with the vertical leg thereof being adapted to be folded over upon itself and provide a double thickness hanger support panel with suitable means, such as an opening or a hook-like cutout, provided at the upper end for supporting the package on an outwardly extending pin of a merchandising rack. The support panel is of substantially the same width as a flattened pair of socks of the type which is adapted to be supported by the package. A hosiery support band is formed by folding the horizontal leg of the L-shaped blank to provide a rear panel integral with and extending downwardly from the hosiery support panel, a front panel of substantially the same width and length as the rear panel, and a pair of side panels of substantially the same length as and connecting opposed side edges of the front and rear panels to maintain the front and rear panels in parallel spaced apart relationship. The side panels are of substantially the same width or slightly less than the width of the flattened pair of socks so that the support band encircles and resiliently engages the medial portion of the pair of flattened socks with the upper and lower end portions of the pair of socks being visible above and below the support band.

BRIEF DESCRIPTION OF THE DRAWINGS

Other objects and advantages of the invention will appear as the description proceeds when taken in connection with the accompanying drawings, in which.

DESCRIPTION OF THE ILLUSTRATED EMBODIMENTS

Figure 5:
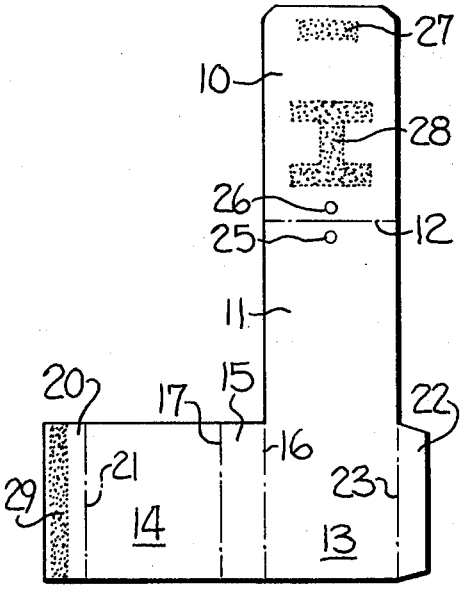
FIG. 5 is an elevational view of the side of the L-shaped paperboard blank which is adapted to form the inner surface of the hanger package.
Figure 6:
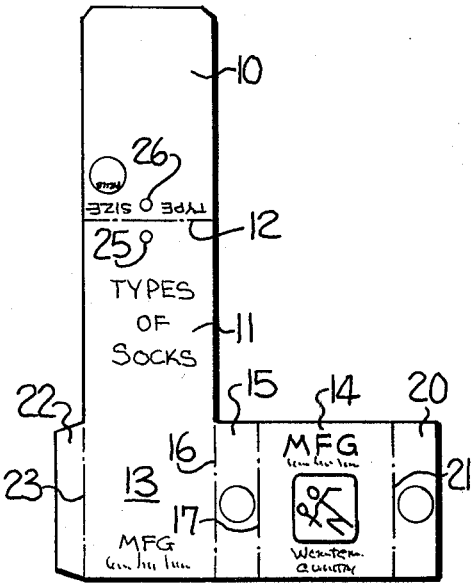
FIG. 6 is a view similar to FIG. 5 but illustrating the opposite side of the L-shaped paperboard blank, the side adapted to form the outside of the hanger package.

The substantially L-shaped paperboard blank shown in FIGS. 5 and 6 is employed to form the present hosiery display hanger package. The vertical leg of the blank includes a pair of rectangular hanger support panels, referred to as a front hanger panel 10 and a rear hanger panel 11, which are joined along a horizontal fold line 12.

The horizontal leg of the L-shaped blank is adapted to form the hosiery support band and includes a rear panel 13 of substantially the same width as the hanger support panel 11. The rear panel 13 has an upper edge which is integral with the lower edge of the panel 11. A front panel 14 of substantially the same width and length as the rear panel 13 is connected thereto by a side panel 15 and along vertical score lines 16 and 17. A second side panel 20 is connected to the front panel 14 along a vertical score line 21. A relatively narrow glueing panel 22 is connected along a vertical score line 23 to one side of the rear panel 13 for purposes to be presently described.

The upper end portion of the support panel 11 is provided with suitable means for supporting the package on an outwardly extending pin of a merchandizing rack, illustrated as a hole 25. A hole 26 is provided in the lower end of the support panel 10 so that it mates with the hole 25 when the panel 10 is folded along the fold line 12 to overlie the rear panel 11. Areas of pressure sensitive adhesive, indicated at 27 and 28, are provided on the inner surface of the support panel 10 (FIG. 5) for use in assembling the display hanger package, in a manner to be presently described. An area of pressure sensitive adhesive, indicated at 29, is also provided on the inner surface of the side panel 20 for attaching the same to the panel 22.

Figure 1:
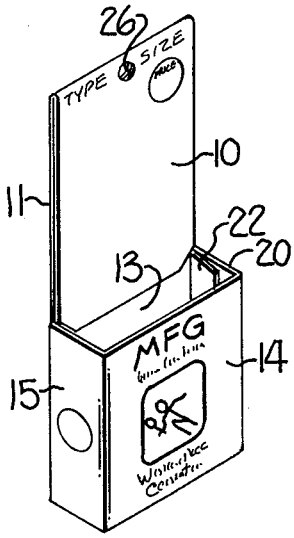
FIG. 1 is an isometric view of the present hosiery display hanger package in assembled condition.

To form the display hanger package illustrated in FIG. 1 from the L-shaped blank shown in FIGS. 5 and 6, the panel 10 is folded along the score line 12 and downwardly over the panel 11 so that the pressure sensitive adhesive areas 27, 28 contact the panel 11 and maintain the same in overlying relationship, as illustrated in FIG. 1, to provide a two layer or double thickness support panel with the holes 25, 26 aligned so that the package may be supported from a pin on a pin-type merchandising rack. The side panels 15, 20 and front panel 14 are folded along the respective fold lines 16, 17 and 21 while the panel 22 is folded along fold line 23 and the side panel 20 is attached to the panel 22 by the pressure sensitive adhesive 29 to form the hosiery support band, as illustrated in FIG. 1.

As indicated in FIG. 6, various types of identification information and advertising matter is printed on one side only of the blank and this side of the blank may be calendered and/or provided with a glossy or laminated finish. Since only the side of the blank which is to form the outer surface of the package has the more expensive finish, the cost of producing the blanks is reduced and the outer surface of the package is more attractive and more soil resistant than the inner surface. As has been mentioned, the dimensions of the panels making up the support band are correlated with the width and thickness of the type of socks to be displayed therein and supported thereby. The dimensions of the panels 13, 14, 15 and 20 are such that the support band encircles and resiliently maintains the medial portion of the socks in substantially a vertical position therein with the upper and lower end portions of the socks being visible above and below the support band. A pair of crew-type socks S is supported in the display package illustrated in FIG. 2.

Figure 2:
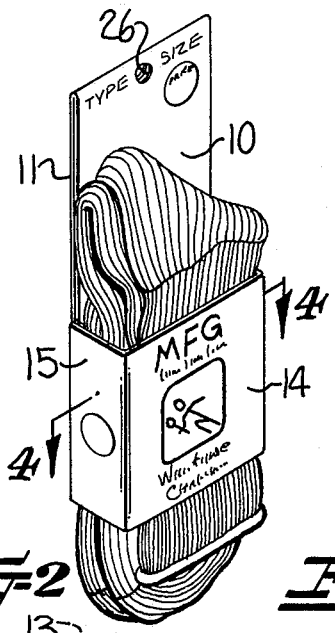
FIG. 2 is a view similar to FIG. 1 but illustrating the display hanger package supporting a folded and flattened pair of crew-type socks therein.
Figure 4:
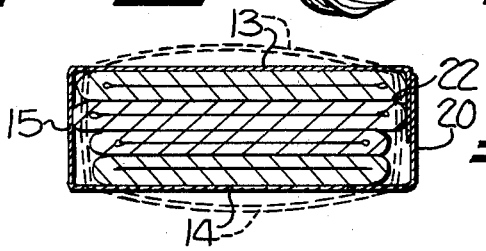
FIG. 4 is an enlarged horizontal sectional view taken substantially along the line 4—4 in FIG. 2 and illustrating the manner in which the support band encircles and resiliently engages the medial portion of the socks held therein.

To insert the pair of socks in the display hanger package, the opposite side panels are depressed so that the rear and front panels 13, 14 bow outwardly away from each other, as indicated in dotted lines in FIG. 4. The pair of folded and flattened socks S is then slipped into the encircling band and the opposite side panels then are released so that the support band resiliently engages and supports the medial portion of the pair of flattened socks. The panels 13, 14, 15 and 20, forming the support band, should have substantial vertical length to engage a substantial area of the medial portion of the socks S. In the package of FIGS. 1 and 2, the panels 13, 14, 15 and 20 are 4 inches from top to bottom and the support panel 10 extends upwardly above the rear panel 13 a distance of $5\frac{1}{2}$ inches. The rear and front panels 13, 14 are each $3\frac{1}{2}$ inches wide while the side panels 15, 20 are 1 3/16 inches wide.

Figure 3:
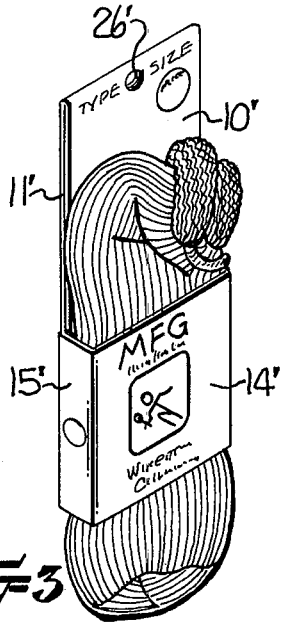
FIG. 3 is a view similar to FIG. 2 but showing a hanger package in which the thickness of the supporting band has been reduced by reducing the width of the pair of side panels so that a thinner pair of flattened hosiery articles, such as low-cut socks, is encircled by and resiliently engaged by the support band.

The hosiery display hanger package of FIG. 3 is illustrated as supporting a pair of low-cut socks S, one inside the other and both supported on a cardboard insert. The package of FIG. 3 includes the same parts as the package of FIGS. 1 and 2 and corresponding parts will bear the same reference characters with the prime notation added. The dimensions of all of the parts of the package of FIG. 3 are the same as the dimensions of the package of FIGS. 1 and 2, except that the width of the side panel 15 and the corresponding side panel, not shown, have been reduced to $\frac{3}{4}$ of an inch. The thickness of the support band has been reduced because the thickness of the low-cut socks S′ is less than the thickness of the crew-type socks S. Thus, the low-cut socks S′ in FIG. 3 are still resiliently engaged by the support band and maintained in a vertical position with portions of the socks being visible above and below the support band.

When the blanks are assembled to form the hosiery display hanger package, as illustrated in FIG. 1, the support band, formed of panels 13, 14, 15 and 20, may be flattened so that a large number of hosiery display hanger packages can be shipped in a relatively small space. Also, the entire outer surface of the display package is formed from one side of the blank, the side illustrated in FIG. 6, so that it is only necessary to provide an expensive finish on one side of the blank. All outwardly facing surfaces of the package can be provided with suitable advertising and/or other identifying indicia while it is necessary to imprint only one side of the blank.

In the drawings and specification, there has been set forth the best mode presently contemplated for the practice of the invention and it is to be recognized that certain variations in detail may be adopted without departing from the essence of the present invention. Although specific terms are employed in describing the present invention, they are used in a generic and descriptive sense only and not for purposes of limitation, the scope of the invention being defined in the claims.

That which is claimed is:

1. The combination of hosiery articles, such as socks, and a hanger package for supporting said hosiery articles for display on a merchandizing rack and comprising (a) a hanger support including upper and lower ends with means associated with said upper end for supporting said package on the merchandizing rack, and (b) a hosiery support band integrally formed with said hanger support for encircling and resiliently maintaining said hosiery articles in substantially a vertical position therein, said hosiery support band including (1) a rear panel of substantially the same width as said hosiery articles and including an upper edge integral with the lower edge of said hanger support, (2) a front panel of substantially the same width as said rear panel, and (3) a pair of side panels connecting opposed side edges of said front and rear panels to maintain said front and rear pannels in parallel spaced apart relationship, said side panels being of substantially the same thickness as said hosiery articles so that said support band encircles and resiliently engages a medial portion of said hosiery articles with the upper and lower end portions of said hosiery articles being visible above and below said support band, said front and rear panels being bowed outwardly when said side panels are depressed toward each other to facilitate insertion of said hosiery articles.

2. The combination according to claim 1 wherein said hanger support is of substantially the same width as said front and rear panels.

3. The combination according to claims 1 or 2 wherein said front panel is of substantially the same length as said rear panel.

4. The combination according to claims 1 or 2 wherein said side panels are of substantially the same length as said rear panel.

5. The combination according to claim 1 wherein said hanger support includes a pair of hanger support panels adhesively connected together.

6. The combination according to claim 5 wherein said hanger support panels include upper ends joined along a fold line, and wherein one of said hanger support panels includes a lower free end terminating at substantially the level of the upper end of said hosiery support band.

7. The combination according to claim 1 wherein said front panel and said side panels of said support band are joined along fold lines with one of said side panels on each side of said front panel, one of said side panels being joined along a fold line to one side of said rear panel, and including a glueing panel joined along a fold line to the other side of said rear panel, the other of said side panels being adhesively connected in overlying relationship to said glueing panel to complete said support band.

* * * * *